US008630758B2

(12) United States Patent
Ehrler et al.

(10) Patent No.: US 8,630,758 B2
(45) Date of Patent: Jan. 14, 2014

(54) METHOD AND APPARATUS FOR SAFETY PROTOCOL VERIFICATION, CONTROL AND MANAGEMENT

(76) Inventors: Eric Ehrler, Fairdale, KY (US); Mark Johnson, Bardstown, KY (US)

( * ) Notice: Subject to any disclaimer, the term of this patent is extended or adjusted under 35 U.S.C. 154(b) by 0 days.

(21) Appl. No.: 13/466,332

(22) Filed: May 8, 2012

(65) Prior Publication Data

US 2013/0304286 A1 Nov. 14, 2013

(51) Int. Cl.

| | |
|---|---|
| ***G05D 1/00*** | (2006.01) |
| ***G08G 1/00*** | (2006.01) |
| ***H04B 3/36*** | (2006.01) |
| ***B61L 5/20*** | (2006.01) |

(52) U.S. Cl.
USPC ..... 701/19; 340/904; 340/407.1; 246/217

(58) Field of Classification Search
USPC ..... 701/19; 33/651, 532.1, 338, 287
See application file for complete search history.

(56) References Cited

U.S. PATENT DOCUMENTS

| | | | | |
|---|---|---|---|---|
| 4,937,795 | A | 6/1990 | Motegi et al. | |
| 5,415,369 | A | 5/1995 | Hungate | |
| 5,554,982 | A | 9/1996 | Shirkey et al. | |
| 5,924,651 | A * | 7/1999 | Penza et al. | 246/124 |
| 5,999,091 | A | 12/1999 | Wortham | |
| 6,232,887 | B1 * | 5/2001 | Carson | 340/903 |
| 6,650,242 | B2 | 11/2003 | Clerk et al. | |
| 6,925,654 | B2 | 8/2005 | De Silva | |
| 7,167,082 | B2 * | 1/2007 | Stigall | 340/407.1 |
| 7,298,258 | B1 | 11/2007 | Hudgens et al. | |
| 7,515,065 | B1 | 4/2009 | Bygrave et al. | |
| 7,592,911 | B1 | 9/2009 | Hudgens et al. | |
| 7,616,099 | B2 * | 11/2009 | Mackjust et al. | 340/426.13 |
| 7,812,740 | B2 * | 10/2010 | Mergen | 340/904 |
| 8,131,456 | B2 * | 3/2012 | Mahalingaiah et al. | 701/117 |
| 2002/0057340 | A1 * | 5/2002 | Fernandez et al. | 348/143 |
| 2004/0004547 | A1 * | 1/2004 | Appelt et al. | 340/573.1 |
| 2004/0090315 | A1 * | 5/2004 | Mackjust et al. | 340/426.13 |
| 2006/0095175 | A1 * | 5/2006 | deWaal et al. | 701/33 |
| 2011/0241827 | A1 * | 10/2011 | Varoglu | 340/5.52 |

* cited by examiner

*Primary Examiner* — Russell Frejd
*Assistant Examiner* — Tyler Paige
(74) *Attorney, Agent, or Firm* — Robert R. Waters; Brian W. Foxworthy; Waters Law Group, PLLC

(57) ABSTRACT

The present invention is an apparatus and a method for a safety verification system, or a safety verification management system. At railroads or construction sites, equipment, such as a piece of heavy machinery, or a locomotive engine, must be subjected to a safety protocol before authorized personnel are allowed to approach the equipment. It is essential to have independent, automatic confirmation that the safety protocol has been successfully completed. In railroad systems, a Three Step Protection Mode is often used to place a locomotive engine in safe mode. One embodiment of the present invention provides an independent, automatic verification that this safety protocol has been successfully completed and sends an audible, visual, audiovisual, or vibratory signal to remote personnel. Another embodiment tracks the relative positions of personnel and locomotives, and generates a warning when personnel are proximate to an equipment that is not in safe mode.

20 Claims, 5 Drawing Sheets

METHOD AND APPARATUS FOR SAFETY PROTOCOL VERIFICATION, CONTROL AND MANAGEMENT

BACKGROUND OF THE INVENTION (a) Technical Field of the Invention

This invention generally relates to the field of safety verification systems, and in particular relates to an electronic signaling system that monitors safety protocols associated with an equipment, and alerts remote personnel upon the satisfactory completion of such protocols. This enables the alerted personnel to approach the equipment safely.

(b) Description of the Relevant Art

A considerable number of patents relate generally to safety protocols and safety verification mechanisms.

In U.S. Pat. No. 4,937,795, Motegi, et al. disclose an access alarm method for the purpose of protecting personnel as they are working on vehicles. As stated in the patent, this could specifically include railroad locomotives, as well as aircraft and a number of other vehicles. With the primary embodiment disclosed by Motegi, the alarm consists of an ultrasonic signal transmitted by a receiver on the vehicle to indicate when an object has entered into a predetermined area of danger relative to the working vehicle. Motegi further discloses an apparatus for transmitting a warning comprising a supersonic wave transmitting and receiving means mounted on an object and a mechanism for determining relative position between a working vehicle and the object upon receipt of an appropriate signal.

Another relevant patent is U.S. Pat. No. 5,415,369 by Hungate. The Hungate invention is a railroad signaling system which includes transceivers disposed at signals, operating at various frequencies so as to provide identification and secure communication between the locomotive and the control mechanisms, including control personnel. The primary emphasis of Hungate is improving the in-cab signaling systems and coupling the same to automatic train stop enforcement devices. In the primary embodiment disclosed, an onboard interrogator is utilized to interrogate transponders disposed between the tracks at a predetermined distance from the signal location. Hungate discloses the use of RF signal processing to achieve the requested communication. The claims of the patent are limited to RF signaling.

U.S. Pat. No. 5,554,982 by Shirkey, et al. discloses a wireless train proximity alert system. This patent is directed to signaling associated with a moving train. The system includes a transceiver located on the train for transmitting a proximity signal. Shirkey notes that this signal would preferably include information about the train's speed as well as physical location. A crossing-based transceiver receives the signal from the train and transmits the boundary coordinates when the train's estimated time of arrival at the crossing is within a predetermined range. A vehicle-based receiver receives the warning zone signal and makes a comparison to the vehicle's position and speed in order to produce an appropriate alarm to aid in preventing potential accidents.

U.S. Pat. No. 5,924,651 by Penza is directed to a train warning system designed to protect personnel working near a train station by providing a warning of moving vehicles. The Penza system includes a sensor for detecting the passing of a train over a track and a transmitter arranged to transmit a warning signal to a portable RF receiver carried by the personnel working in the vicinity of the tracks. The portable RF generator may serve to alert personnel to the movement of the vehicle or any number of other hazards associated with the work. The alarm may be either visual or audible.

Another warning system is found in U.S. Pat. No. 6,232,887 B1 by Carson. The Carson system includes a receiver-transmitter arrangement for sending an alert signal to warn of an approaching vehicle. The Carson system further discloses an alarm system that communicates qualitative information about the approaching vehicle as well, including the speed of the vehicle and a ping signal which serves to verify communications between the receiver and the transmitter. As shown in FIG. 2 of the Carson patent, the embodiments include a vest-mounted alarm system.

U.S. Pat. No. 6,650,242 B2 by Clerk, et al. discloses a proximity detection system to be used such as to transmit general alarm signals to warn people of approaching vehicles. The Clerk system has applicability in a number of settings including factory floors, and the RF-based system could easily be adapted to a railroad application. U.S. Pat. No. 5,999,091 by Wortham is directed to a trailer communication system with general applicability, and a good discussion of signal technology. U.S. Pat. No. 6,925,654 B2 by De Silva pertains to an alarm-based jacket that can be worn by riders of a motorcycle, for example, to aid in producing visual alarms for general biker safety.

U.S. Pat. No. 7,167,082 B2 by Stigall claims an alarm system for generating and issuing a plurality of differing types of warning messages associated with specific types of hazards. The Stigall patent involves generating a different type of "stimulus" in differing situations. Examples given include visual alarms, flashing alarms and vibration signals. The visual stimuli may be situated on a hard hat worn by the user. The Stigall system has particular application in a wide assortment of construction applications and this could include the use by railroad workers. The process of altering the type of stimulus as a function of the differing hazards anticipated appears to be the point of novelty with Stigall.

U.S. Pat. No. 7,298,258 B1 and U.S. Pat. No. 8,592,911 B1 are related patents by Hudgens, et al., both claiming a construction hard hat with particular electronic circuitry. The Hudgens patents include a mechanism whereby the warning signals generated and transmitted to hard hats worn by personnel at a construction site may be personalized to the particular employee receiving the warning. In that sense, while still functioning primarily as a warning system, the Hudgens hard hats take on some characteristics of a paging system.

In addition, U.S. Pat. No. 7,515,065 B1 by Bygrave, et al. and U.S. Pat. No. 7,812,740 B2 by Mergen are also warning systems for vehicles with general applicability. In both cases, the patents are directed to alerting pedestrians or personnel within a specific vicinity of an approaching vehicular hazard.

SUMMARY OF THE INVENTION

The present invention is a safety verification and management system which has immediate applicability for railroads, but which may also be used in a number of other industries with mild alteration. The purpose of the 3-step protection light ("3-spl") is to provide an additional automated safety check that would serve to verify that human safety controls have been appropriately exercised. Specifically, one embodiment of the device enables an automatic visual and audible alarm to verify that appropriate controls of a locomotive engine have been engaged. The applicability to railroad safety is significant because the act of safely parking and controlling a locomotive requires multiple steps from different individuals. It is, of course, vital that a locomotive engine be appropriately anchored prior to routine maintenance being performed. In the standard railroad safety mechanism, a three-step protection protocol is utilized wherein the engineer takes the steps of (1) centering the reverser, (2) turning off the generator field, and (3) fully applying the independent brake. Although these steps or conditions are well known and mandatory, it is possible that human error or oversight could interfere with the execution of the three-step protection protocol. In such a situation, the oversight could be deadly. This invention is directed to providing an automated veracity check on the three-step protection protocol.

One embodiment of the present invention involves a receiver mechanism that includes both a light and a speaker which are worn by the conductor and brakeman. Other embodiments may have different signaling mechanisms. The receiver mechanism may be attached to or integrated into a safety vest or hard hat worn by the crew members. A transmitter mechanism is located on the locomotive. After the three-step protection protocol is exercised, the transmitter mechanism will verify the protocol and provide a visual and audible signal to the receiver mechanism, thereby alerting the crew members that the three-step protection mode has been appropriately engaged.

This invention could be highly desirable to railroad personnel as a means of further protecting railroad employees from serious injury or death. In addition, the present invention has applicability to a variety of other industrial settings wherein the actions of multiple individuals are used to control dangerous equipment. Examples of this could include the lockout tagout system typically used by utilities to de-energize power lines and power equipment.

These and other features, variations and advantages which characterize this invention, will be apparent to those skilled in the art, from a reading of the following detailed description and a review of the associated drawings.

Additional features and advantages of this invention will be understood from the detailed descriptions provided. This description, however, is not meant to limit the embodiments, and merely serves the purpose of describing some structural embodiments.

BRIEF DESCRIPTION OF THE DRAWINGS

A better understanding of the present invention will be had upon reference to the following description in conjunction with the accompanying drawings, wherein.

DETAILED DESCRIPTION OF EMBODIMENTS

While the invention will be described in connection with certain embodiments, the description should not be construed to limit the invention to these embodiments. On the contrary, the intent is to cover all alternatives, modifications and equivalents as included within the spirit and scope of the invention. Various changes may be made to the function and arrangement of the elements described herein, without changing the scope of the invention being disclosed. It should be noted that the following description serves to teach at least one instance of how the various elements may be arranged to achieve the stated goals of this invention.

Figure 1:
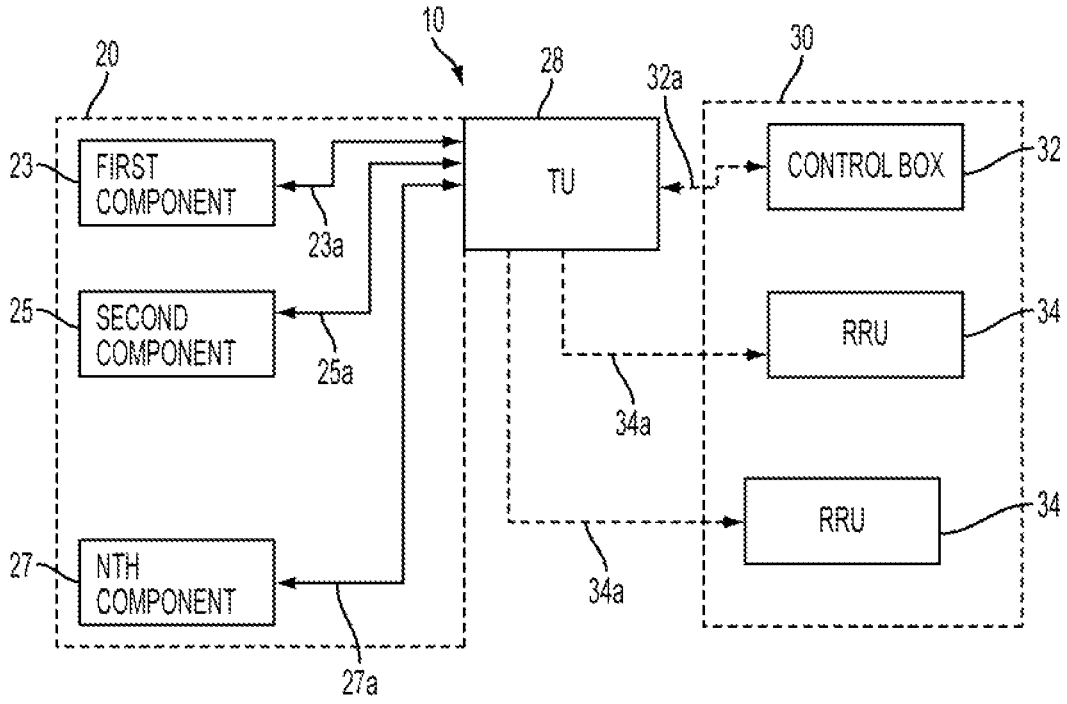
FIG. 1 is one embodiment of electronic circuitry for a safety verification system.

FIG. 1 is a block diagram for one embodiment of a safety system 10, showing its electronic circuitry. Equipment 20 is shown with an attached Transceiver or Transmitter Unit ("TU") 28. The equipment itself may comprise of a plurality of interlinked components. Each such component may be in one of two states—either engaged or disengaged. The figure shows a first component 23, a second component 25, and an N-th component 27. Component 23 is connected to TU 28 via a two-way connection 23*a*; component 25 is connected to TU 28 via a two-way connection 25*a*; and component 27 is connected to TU 28 via a two-way connection 27*a*. Also shown in the figure is a collection of remote devices 30. Such devices may consist of at least one control box 32, and one or more remote receiving units ("RRUs") 34. In the embodiment shown, control box 32 is connected to TU 28 via a two-way connection 32*a*; and RRU 34 is connected to TU 28 via a one-way connection 34*a*.

At construction sites, or around locomotive engines, it is important to determine if an equipment, particularly, hazardous equipment, has been disengaged, so as to eliminate hazards to personnel working in or around such equipment. To make equipment 20 safe, one or more interlocking components need to be disengaged and the appropriate personnel need to be informed that equipment 20 is now disengaged and presents no hazards. In the existing art, much of this operation is manual, and the communications are not automated. This gives rise to the risk of human error, causing extremely dangerous conditions, and often resulting in serious injuries, or even fatalities. These dangerous conditions may be largely mitigated by the use of automated communication devices. In the present invention, a control box 30 communicates with TU 28 and signals TU 28 to execute one or more steps or conditions of a safety protocol. The control box may contain a processor and programming logic so as to be programmed to operate automatically. Alternatively, it may be operated manually, sometimes remotely by a remote control operator ("RCO"). TU 28 in turn communicates with a first interlocking component 23 via network 23*a*, which may be a physical or wireless network. When the first component 23 is duly engaged, it sends a signal back to TU 28 over network 23*a*. Similar communications are maintained with all the other interlocking components within the equipment that form a part of the safety protocol. Once TU 28 receives information that all components are properly engaged, it transmits a signal to control box 32 over network 32*a*. This informs the RCO that all interlocking components have been properly engaged, and the safety protocol has been successfully completed, and therefore the locomotive is in safe mode. TU 28 contains a processor and may be programmed appropriately to send multiple, simultaneous signals to one or more RRUs 34 over network 34*a*. RRU 34 relays the signal via visual, audio, audiovisual, or vibratory means. In some embodiments, RRU 34 is equipped with a visual indicator. The visual indicator is on when the locomotive is in safe mode, it flashes when the locomotive is in unsafe mode, and it is off when the locomotive safety protocol is disabled. In some other embodiments, RRU 34 may be equipped with an audible alarm. Each RRU 34 is carried by personnel working in or around equipment 20. RRU 34 may be removably attached to an article of clothing such as a vest, a headgear or belt. Thus, all personnel wearing such an article of clothing are capable of receiving automatic confirmation that the equipment is safe for appropriate work. When the safety protocol is no longer needed (or disabled), TU 28 communicates with RRU 34, which immediately ceases to emit its signal. When the safety protocol is violated by the disengagement of one or more interlocking components, TU 28 communicates with RRU 34, which immediately emits a visual signal by flashing its lights, or generates an audible or vibratory alarm, thus warning personnel that it is no longer safe to work near equipment 20.

Figure 2:
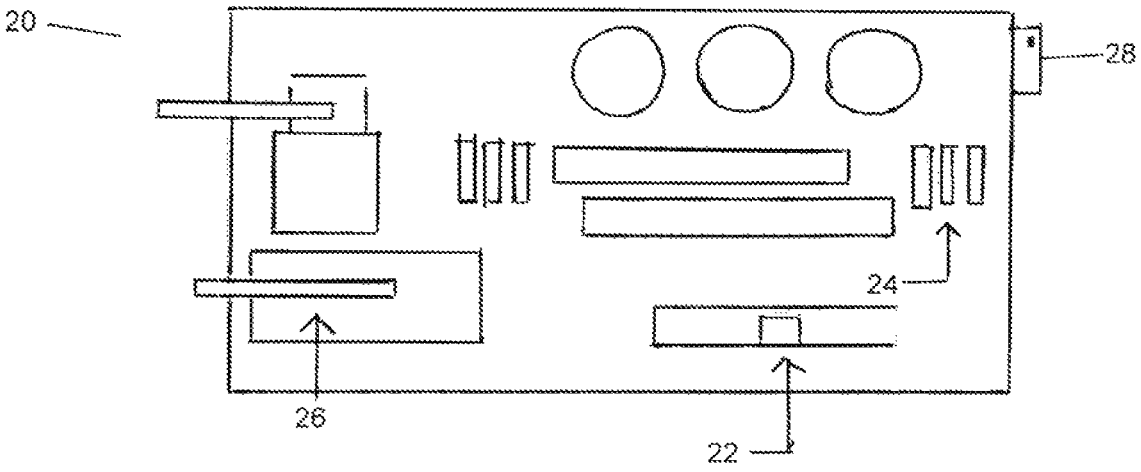
FIG. 2 is a top view of components of an embodiment of a safety system in a locomotive.

FIG. 2 is a top view of the components of a particular embodiment of a safety system in equipment 20, which, in this case, is a locomotive. Such a system may be used, for instance, during regular switch moves. During switch moves, the conductor or brakeman will ask the Engineer to place the locomotive engine in "Three Step" Mode. This safety mode helps inform the conductor, brakeman, and other personnel that the engine will not move, while these personnel are fouling equipment. As used herein, fouling equipment means to work on, under, or under the locomotive, while inside the gauge of the rail. To place the locomotive engine in Three Step Protection mode, the engineer will first center the reverser lever 22, turn the generator field 24 off, and fully apply the independent brake 26. These steps or conditions may be executed in any order. Upon completion of all three steps or conditions, the engineer communicates the successful completion of this safety protocol to the conductor, brakeman, and other personnel. Such communication is often accomplished by the use of radio or hand signals, which is unreliable and subject to human error. Moreover, the engineer is unable to receive an independent confirmation of the completion of this safety protocol. In one embodiment of the present invention as shown in FIG. 2, a TU 28 is affixed to engine 20. When reverser lever 22 is duly engaged, in this instance, when it is properly centered, it sends a signal back to TU 28. Next, when the generator switch 24 is properly engaged, in this instance when it is switched off, it sends a signal back to TU 28. Finally, when independent brake 26 is duly engaged, in this instance, when it is fully applied, it sends a signal back to TU 28. Once TU 28 receives independent, automated, confirmation that all three components are properly engaged, it transmits a signal to the engineer. The engineer may be an RCO with a control box. This gives the engineer independent confirmation that all three steps or conditions having been properly engaged, and the safety protocol has been successfully completed.

Figure 3A:
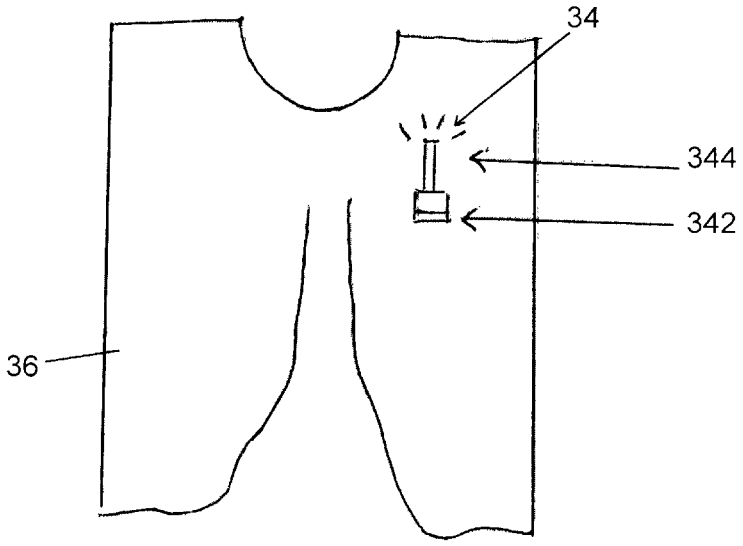
FIG. 3A shows an embodiment of a receiving unit removably attached to a vest.
Figure 3B:
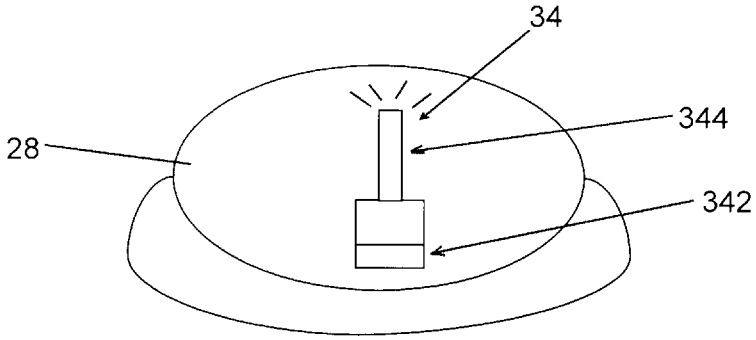
FIG. 3B shows an embodiment of a receiving unit removably attached to a hard hat.

As discussed earlier with reference to FIG. 1, TU 28 may be programmed appropriately to send multiple, simultaneous signals to one or more RRUs 34 over network 34*a*. The signal itself may be visual, audio, audiovisual, or vibratory. Each RRU 34 may be carried by personnel working in or around equipment 20. In some situations, RRU 34 may be removably attached to an article of clothing, including, but no limited to, a vest, a hard hat, a belt, etc. worn by the appropriate personnel. In some instances, RRU 34 may be removably attached to the appropriate personnel by using an arm band made of Velcro or other suitable material. FIG. 3A shows an embodiment of RRU 34 removably attached to a vest 36. FIG. 3B shows an embodiment of RRU 34 removably attached to a hard hat or helmet 38. Such a vest 36 or hard hat 38 may be worn by personnel who are working in or around hazardous equipment. In the context of railroad zones, the conductor, brakeman, and other railroad personnel may be appropriately fitted with such a vest 36. In construction zones, authorized workers may wear a hard hat 38 fitted with RRU 34. Each RRU 34 comprises a battery 342 and a receiver 344. Receiver 344 receives a signal from TU 28 upon successful completion of an appropriate safety protocol. RRU 34 may emit an audible, visual, audiovisual, or vibratory signal. Thus remote personnel are automatically informed when it is safe to work around hazardous equipment.

In railroad work zones, there are often multiple RCOs operating multiple locomotives. It is often difficult for an RCO to identify the particular locomotive that is being operated by the control box. This problem may be solved in some embodiments of the present invention by equipping the control box with a direction detection and display package. The control box communicates with TU 28 and the signal exchange may be analyzed by the control box to detect the source of the signal, thereby determining the direction of locomotive 20. This direction is then displayed by an appropriate display, pointing the RCO to the locomotive that is being operated by his control box.

Figure 4:
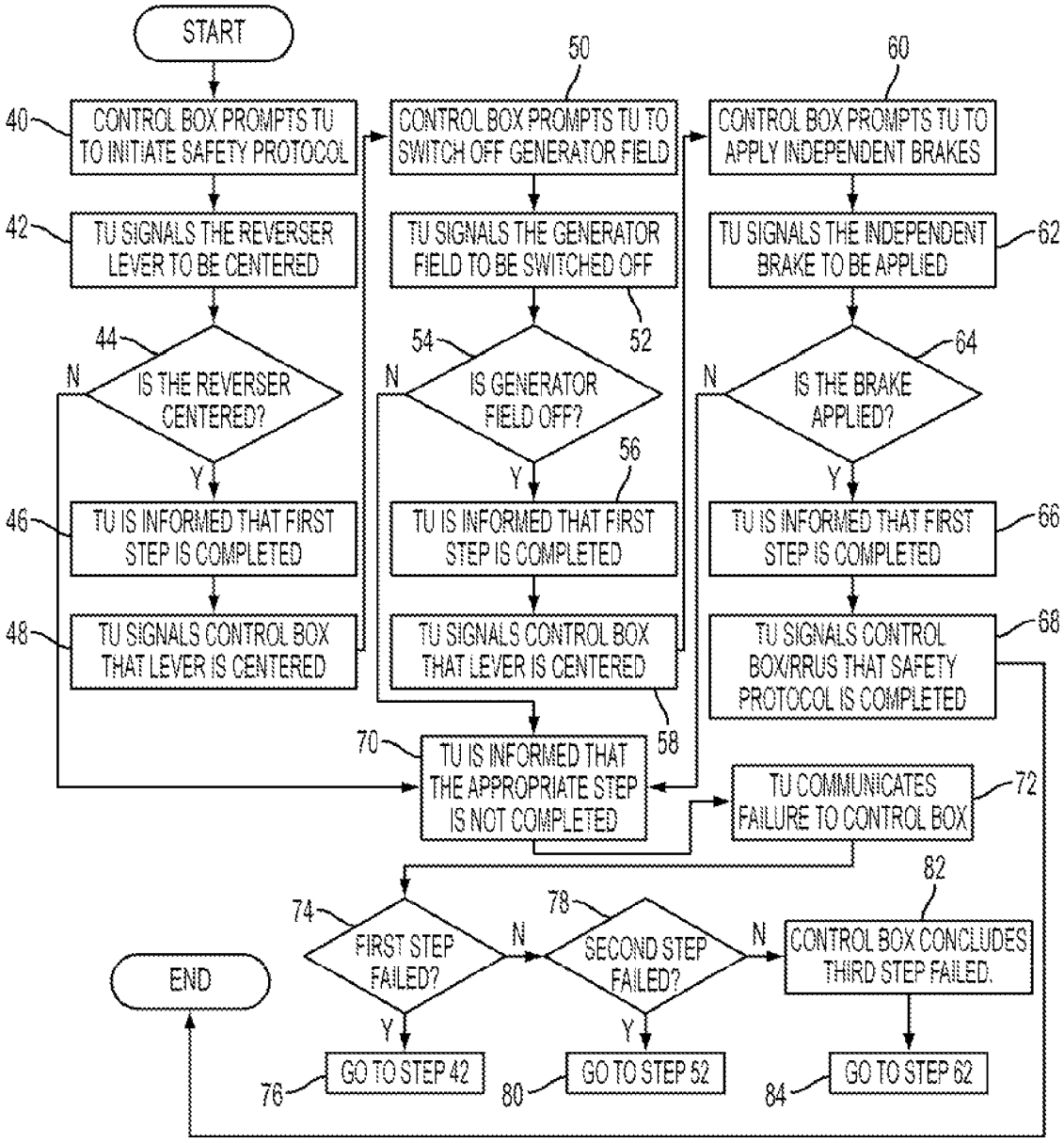
FIG. 4 is a flow chart illustrating one embodiment of a method for a safety verification and control system in a locomotive.

Turning now to FIG. 4, a flow chart shows a method for a safety verification and control system in a locomotive. In particular, a control box communicates to the TU to initiate the Three Step Protection Mode at a step 40. TU then communicates command to the first component, in this case, to center the reverser lever, at a step 42. At step 44, a logic circuit connected to the reverser lever determines whether the lever was successfully centered. An affirmative answer is communicated back to the TU at step 46. TU then communicates to the control box that the first safety step has been successfully completed, at step 48. Subsequently, the control box communicates to TU to execute the engagement of the second interlocking component, at step 50. TU then communicates a command to the second component, in this case, to switch off the generator field, at a step 52. At step 54, a logic circuit connected to the generator determines whether the generator field was successfully switched off. An affirmative answer is communicated back to the TU at step 56. TU then communicates to the control box that the second safety step has been successfully completed, at step 58. Subsequently, the control box communicates to TU to execute the engagement of the third interlocking component, at step 60. TU then communicates a command to the third component, in this case, to fully apply the independent brake, at a step 62. At step 64, a logic circuit connected to the brake determines whether the brake was successfully applied. An affirmative answer is communicated back to the TU at step 66. TU then communicates to the control box that the third safety step has been successfully completed, and that the Three Step Protection Mode is now activated, at step 68. When appropriate, TU also communicates to RRUs that the Three Step Protection Mode is now activated.

If the logic circuit at any of the steps 44, 54, or 64, returns a negative answer, this information is transmitted to TU at step 70. TU then communicates failure of the respective safety step to control box at step 72. Subsequently, at step 74, a logic circuit in the control box determines if the first component failed to engage. If yes, then at step 76, the control box initiates a new command to TR to re-attempt to execute that particular safety step at 42. If no, then at step 78, the logic circuit in the control box determines if the second component failed to engage. If yes, then at step 80, the control box initiates a new command to TR to re-attempt to execute that particular safety step at 52. If no, then at step 82, the microprocessor in the control box determines that the third component must have failed to engage. At step 84, the control box initiates a new command to TR to re-attempt to execute that particular safety step at 62.

It should be noted that FIG. 4 illustrates one embodiment of a method to successfully complete the appropriate safety protocol. Although the method illustrates the method as applied to a locomotive engine with three safety steps or conditions, multiple safety steps or conditions may be easily added. The steps or conditions may be executed in any desired order. Moreover, this method applies to any equipment where a plurality of components may need to be engaged prior to successful completion of a safety protocol. Additionally, the method itself may be suitably varied or modified. For instance, at any of steps 76, 80, or 84, the operator may decide to abort or disable the safety protocol. In a different embodiment, one or more of the logic circuits at steps 44, 54, or 64 may communicate remotely with the respective components. These and other variations will be apparent to one skilled in the art, and are included within the scope of the present invention.

Figure 5:
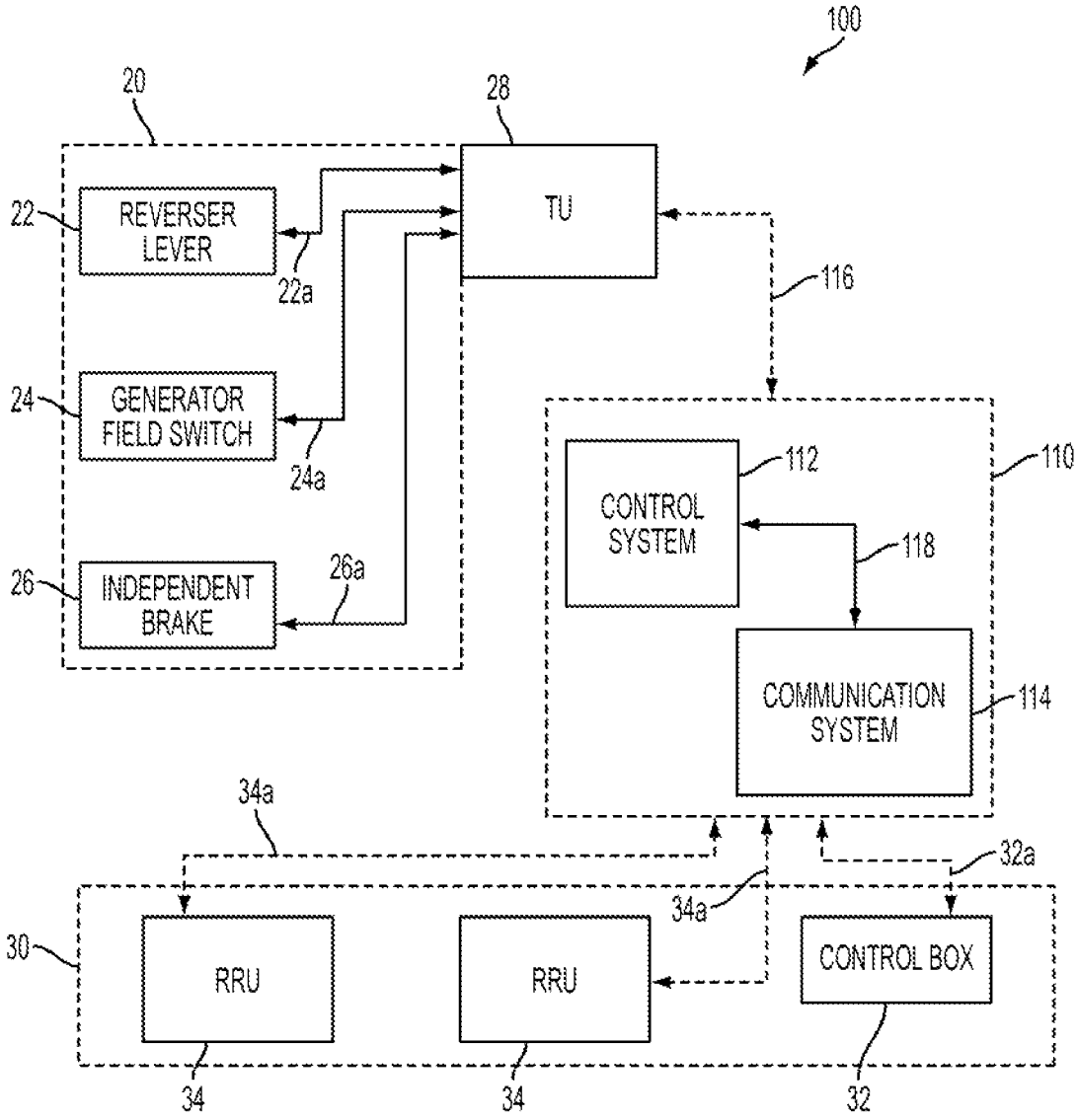
FIG. 5 is one embodiment of electronic circuitry for a safety verification management system.

Turning now to FIG. 5, one embodiment of electronic circuitry for safety verification management system 100 is shown. The embodiment illustrated here is a modification of the safety verification system 10 shown in FIG. 1, with two important additions: all the communication networks are two-way networks; and a management module 110 has been added. One embodiment of management module 110 comprises of a control system 112 and a communication system 114, which communicate over a two-way network 118. Both the control system 112 and the communication system 114 have processors. The management module 110 communicates with TU 28 over network 116; with one or more control boxes 32 over network 32*a*, and with one or more RRUs 34 over network 34*a*. Each TU, control box and RRU is equipped with geographical location software, such as a GPS system, and periodically updates its location information to management module 110 via communication system 114. Control system 112 maintains a continually updated database of the relative positions of all personnel carrying control boxes or TRUs, and certain locomotives, in particular, those that are being actively controlled by one or more control boxes. Each control box, and one or more of the TUs and RRUs may also be equipped with a direction detection and display package. Each TU is associated with a control box and a set of RRUs. Relative positions of these objects are continually updated on the counters or displays. In some embodiments, a map of the target area may be displayed on a monitor, with real-time locations of a TU, RCO and RRUs. This allows the RCO to know for certain which locomotive engine is being controlled by the operation of a particular control box.

Control system 112 may be further configured with appropriate software that monitors the relative positions of personnel such as an RCO or those carrying RRUs, so that when these personnel come within a certain predetermined radius of a locomotive engine for which a Three Step Protection Module has not been successfully completed, the control system 112 prompts communication system 114 to generate an audible, visible, audiovisual, or vibratory alarm that warns the appropriate personnel that they are proximate to a hazardous equipment in unsafe mode, a potentially dangerous situation.

In addition to the modifications already discussed, the management system 100 may also carry out the functions of a safety verification system as shown in FIG. 1. In particular, a control box 32 communicates with TU 28 via communication system 114, and signals TU 28 to execute one or more safety protocols. The control box 32 may be programmed to operate automatically. Alternatively, the control box may be managed by the control system 112. Alternatively, the control box may be operated manually, sometimes remotely by a RCO. TU 28 in turn communicates with the reverser lever 22 via network 22*a*, which may be a physical or wireless network. When the reverser lever 22 is centered, it sends a signal back to TU 28 over network 22*a*. Upon successful centering of the reverser lever, TU 28 communicates with management system 110. Control system 112 then instructs TU 28 to initiate the next step. TU 28 communicates with the generator switch 24 via network 24*a*, which may be a physical or wireless network. When the generator switch 24 is switched off, it sends a signal back to TU 28 over network 24*a*. Upon successful completion of this step, TU 28 communicates with management system 110. Control system 112 then instructs TU 28 to initiate the next step. TU 28 communicates with the independent brake 26 via network 26*a*, which may be a physical or wireless network. When the independent brake 26 is fully applied, it sends a signal back to TU 28 over network 26*a*. Once TU 28 receives information that all components are properly engaged, it transmits a signal to control system 112 over network 116 that the locomotive is in safe mode. The management system 110 then informs the RCO and RRUs that the Three Step Protection module has been successfully completed. The steps or conditions may be executed in any order.

Figure 6:
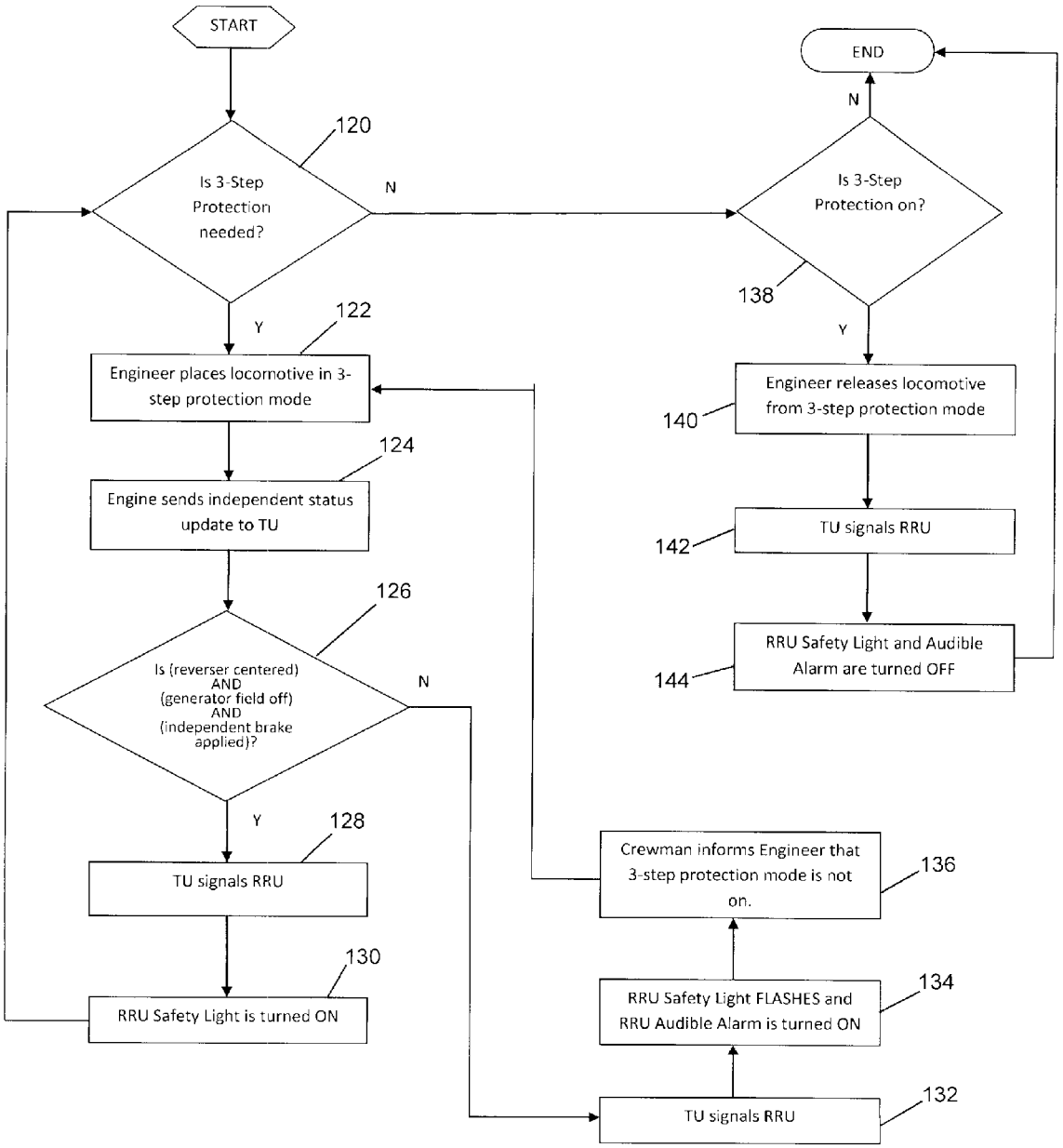
FIG. 6 is a flow chart illustrating another embodiment of a method for an independent safety verification system in a locomotive.

Turning now to FIG. 6, a flow chart shows a method for an independent safety verification system in a locomotive. The system comprises a Transceiver or Transmitter Unit ("TU") and a Remote Receiving Unit ("RRU"). Typically, the TU is attached to the locomotive engine, but in some embodiments, the TU may be part of a remote safety management system. The RRU is carried by one or more crew members. The RRU may be removably attached to a vest, a helmet, a belt, or some other article of clothing or clothing accessories worn by the crew member. In a typical railroad locomotive worksite, a crew member requests an engineer to place a subject locomotive in safe mode, as represented by step 120. At step 122, the engineer places the locomotive in safe mode by initiating and completing the 3-step protection mode and sends a manual confirmation to the crew member that the locomotive engine is in safe mode. The crew member has no way to verify whether safe mode has actually been achieved. In particular, if the engineer fails to place the locomotive in safe mode and the crew member initiates work on the locomotive, an immediate zone of danger is created and the crew member is placed at considerable risk of serious injury, or even loss of life. Such an impending accident is prevented by this invention.

At step 124, the locomotive engine sends an independent status update to TU. At step 126, TU continually monitors the state of the safety protocol. When the engine independently confirms that all three steps or conditions of the safety protocol are successfully completed, TU signals RRU at step 128 that the locomotive is in safe mode, whereupon a safety light on the RRU is turned on at step 130. On the other hand, at step 126, if TU determines that any of the three steps or conditions in the safety protocol is not properly completed, TU signal RRU at step 132 that the locomotive is in unsafe mode, whereupon at step 134, the safety light on RRU flashes and an audible alarm may also begin to sound. This alerts the crew member to immediately move out of the zone of danger. At step 136, crew member informs the engineer that the locomotive is in unsafe mode. At step 122, engineer re-attempts to place the locomotive in three step protection mode. If during this cycle, the process reaches step 130, then the flashing light and audible alarm on the RRU are turned off, while the safety light on the RRU is turned on.

If at step 120, the crew member no longer needs the engine to be in safe mode, then he signals that the safety protocol be disabled. The safety verification system determines if the protection mode is currently on in step 138. If the safety mode is disabled, the process terminates. Otherwise, at step 140, engineer disables the safety mode by releasing the locomotive from the safety protection mode. At step 142, TU signals RRU, and at step 144, the safety light on the RRU is turned off, and the process terminates.

While many novel features have been described above, the invention is not limited to these physical embodiments. It is described and illustrated with particularity so that that those skilled in the art may understand all other embodiments that may arise due to modifications, changes in the geometry and placement of the relative components, omissions and substitutions of these embodiments that are still nonetheless within the scope of this invention.

We claim:

1. A safety protocol verification system for an equipment comprising:

a safety protocol for said equipment;

said protocol comprising of N independent conditions;

each independent condition changeable by an independent action;

said N being greater than one;

said protocol comprising at least two states; and at least one said state of said protocol disabling or limiting the operation of said equipment;

a transmitting unit housing a processor within its interior;

at least one receiving unit;

said processor of said transmitting unit monitoring the states of said N independent conditions and said transmitting unit communicating said states to said receiving unit.

2. The verification system of claim 1, wherein:

said receiving unit is removably attached to an article of clothing.

3. The verification system of claim 1, wherein:

said receiving unit includes a visual indicator;

said visual indicator on said receiving unit displaying the states of said N independent conditions.

4. The verification system of claim 1, wherein:

said receiving unit includes an audible alarm generator.

5. The verification system of claim 3, wherein:

said equipment is a locomotive engine;

said engine includes a reverser lever, a generator field, and an independent brake.

6. The verification system of claim 5, wherein:

said N equals three;

said protocol further comprises the conditions of centering said lever, switching said generator field off, and fully applying said independent brake;

said states of said protocol comprising safe mode, unsafe mode, and disabled;

said visual indicator being on in safe mode;

said visual indicator flashing in unsafe mode;

said visual indicator being off when disabled.

7. The verification system of claim 6, wherein:

said receiving unit includes an audible alarm generator;

said audible alarm sounds an alarm when said protocol is in unsafe mode.

8. The verification system of claim 1, wherein:

said receiving unit further comprises a direction detection and display package;

said package displays a visual indicator pointing to said equipment in communication with said receiving unit.

9. A method of monitoring and communicating the state of a safety protocol for an equipment, the method comprising the steps of:

a user requesting said protocol;

said protocol comprising N independent conditions;

each independent condition changeable by an independent action;

said N being greater than one;

said protocol comprising at least two states; and at least one said state of said protocol disabling or limiting the operation of said equipment;

said protocol being completed;

said equipment independently transmitting the state of each said independent condition to a receiving unit carried by said user;

said monitoring and communication being achieved by:

a transmitting unit housing a processor within its interior;

at least one receiving unit;

said transmitting unit monitoring said N independent conditions and communicating the states of said N independent conditions to said receiving unit.

10. The method of claim 9, further comprising:

removably attaching said receiving unit to an article of clothing worn by said user.

11. The method of claim 9, further comprising:

visually indicating, with a visual indicator on said receiving unit, the state of said safety protocol, wherein;

said equipment is a locomotive engine;

said engine includes a reverser lever, a generator field, and an independent brake;

said N equals three;

said N independent conditions comprise the position of said lever, the state of said generator field, and the status of said independent brake;

said states of said protocol comprising safe mode, unsafe mode, and disabled;

said visual indicator being on in safe mode;

said visual indicator flashing in unsafe mode;

said visual indicator being off when disabled.

12. A safety protocol verification, control, and management system for one or more equipments comprising:

a safety protocol for said equipment;

said protocol comprising of N conditions;

said N being greater than one;

said protocol comprising at least two states;

a transceiver unit having a processor within its interior;

at least one receiving unit;

said receiving unit further having a processor within its interior;

a management module;

said module further comprising a control system and a communication system;

said control system further comprising a real-time database containing the current state of safety protocol on each equipment;

said communication system maintaining real-time two-way network communication with said receiving and transceiver units;

said control system and communication system being connected over a two-way network;

said receiving unit transmitting protocol requests to said control system;

said control system commanding said transceiver unit to execute said protocol;

said transceiver unit executing said N conditions of said protocol;

said transceiver unit monitoring said state of said protocol and communicating said state to said control system;

said receiving unit receiving updates on said state of safety protocol.

13. The management system of claim 12, wherein:

said receiving unit is removably attached to an article of clothing.

14. The management system of claim 12, wherein:

said control system further comprises a real-time database tracking the location of said equipment and personnel carrying said receiving unit.

15. The management system of claim 14, wherein:

said control system further transmits an alarm signal to said receiving unit when said personnel approach within a certain pre-determined proximity of an equipment.

16. The management system of claim 12, wherein:

at least one of said equipment is a locomotive engine;

said engine includes a reverser lever, a generator field, and an independent brake;

said N equals three;

said states of said protocol comprising safe mode, unsafe mode, and disabled;

said receiving unit having a visual indicator;

said visual indicator on said receiving unit displaying said state of said protocol;

said visual indicator being on when in safe mode;

said visual indicator flashing when in unsafe mode;

said visual indicator being off when disabled;

said safe mode comprising the conditions of centering said lever, switching said generator field off, and fully applying said independent brake.

17. The management system of claim 12, wherein:

said receiving unit has an audible alarm generator.

18. The management system of claim 16, wherein:

said receiving unit has an audible alarm generator;

said audible alarm sounds an alarm when in unsafe mode.

19. The management system of claim 12, wherein:

said receiving unit further comprises a direction detection and display package;

said package displays a visual indicator pointing to said equipment in communication with said receiving unit.

20. The management system of claim 12, further comprising a control box;

said control box is equipped with a processor to remotely control said management module.

* * * * *